US007731278B1

(12) United States Patent
Brownlee

(10) Patent No.: US 7,731,278 B1
(45) Date of Patent: Jun. 8, 2010

(54) SHOOTING SUPPORT BENCH

(76) Inventor: Walter L. Brownlee, 1110 First Ave. SE., Watertown, SD (US) 57201

( * ) Notice: Subject to any disclaimer, the term of this patent is extended or adjusted under 35 U.S.C. 154(b) by 1104 days.

(21) Appl. No.: 11/394,790

(22) Filed: Mar. 31, 2006

(51) Int. Cl.
*F41C 27/00* (2006.01)

(52) U.S. Cl. ..... 297/174 R; 297/156; 248/170; 42/94

(58) Field of Classification Search ..... 297/170, 297/174 R, 156, 344.21, 344.22; 108/6, 108/9; 248/170; 42/94
See application file for complete search history.

(56) References Cited

U.S. PATENT DOCUMENTS

| | | | | | |
|---|---|---|---|---|---|
| 559,330 | A * | 4/1896 | Hill | 297/169 |
| 2,244,391 | A * | 6/1941 | De Lisle | 108/9 |
| 4,909,491 | A * | 3/1990 | Cheng | 269/16 |
| 5,082,222 | A * | 1/1992 | Hsu | 248/170 |
| 5,833,308 | A * | 11/1998 | Strong et al. | 297/172 |
| 6,058,641 | A * | 5/2000 | Vecqueray | 248/425 |
| 6,443,345 | B1 * | 9/2002 | Bloemer et al. | 224/519 |
| 6,722,380 | B1 * | 4/2004 | Hafer | 248/514 |
| 6,895,709 | B1 * | 5/2005 | Krien et al. | 42/94 |
| 7,152,358 | B1 * | 12/2006 | LeAnna et al. | 42/94 |

* cited by examiner

*Primary Examiner*—Peter R. Brown
(74) *Attorney, Agent, or Firm*—Jeffrey A. Proehl; Woods, Fuller, Shultz and Smith P.C.

(57) ABSTRACT

A shooting support bench is disclosed for supporting a firearm, and which comprises a riser assembly for positioning on a support surface. The riser assembly comprises a standard having an upper end and a lower end; and a plurality of leg assemblies pivotally mounted on the standard toward the lower end. The bench further comprises a support assembly rotatably mounted on the upper end of the standard, and a seat assembly removably mounted on the seat support assembly for rotation with the support assembly with respect to the riser assembly. The bench also comprises a platform assembly mounted on the support assembly and the riser assembly, the platform assembly being positioned above the upper end of the standard and being rotatable with respect to the riser assembly.

20 Claims, 7 Drawing Sheets

SHOOTING SUPPORT BENCH

BACKGROUND OF THE INVENTION

1. Field of the Invention

The present invention relates to shooting benches and more particularly pertains to a new shooting support bench with enhanced strength and stability while providing collapsibility and a high degree of adjustability.

2. Description of the Prior Art

Recreational shooting of firearms, such as target shooting, benefits can be more enjoyable when the shooter is able to shoot the firearm from a steady platform that resists the movement of the firearm that can cause poor shots. Firearm shooting rests, such as is disclosed in my U.S. Pat. No. 6,877,266, are useful and convenient for steadying the firearm during shooting, but such rests are typically short in the vertical direction and need to be rested on a raised surface if the shooter desires to sit or stand rather than lie prone. However, the performance of even the most solid and sturdy shooting rest can be compromised by a placing it on a support that is not as solid and stable as the shooting rest.

Shooting tables or benches have been developed for the purpose of stably supporting the shooting rests, but the known shooting benches have suffered from some significant problems that has made their performance less than desirable. Putting aside for the moment the lack of quality that has compromised the stability of many of the known shooting benches, these benches have suffered from the inability to provide the shooter with sufficient adjustments to provide a level support for the shooting rest. The ease of adjustability of the known shooting benches has also been less than optimal, particularly in quickly adjusting the height of the bench for sitting and standing heights. Further, the fine adjustment after the course adjustment needs to be accurate to set.

It is therefore believed that there is a need in the art for a shooting support bench with greater stability and adjustability than known benches.

SUMMARY OF THE INVENTION

In view of the foregoing disadvantages inherent in the known types of shooting benches now present in the prior art, the present invention includes a new shooting support bench that features enhanced strength and stability while providing collapsibility and a high degree of adjustability.

To attain this, the present invention generally comprises a shooting support bench for supporting a firearm, and which comprises a riser assembly for positioning on a support surface. The riser assembly comprises a standard having an upper end and a lower end; and a plurality of leg assemblies pivotally mounted on the standard toward the lower end. The bench further comprises a support assembly rotatably mounted on the upper end of the standard, and a seat assembly removably mounted on the seat support assembly for rotation with the support assembly with respect to the riser assembly. The bench also comprises a platform assembly mounted on the support assembly and the riser assembly, the platform assembly being positioned above the upper end of the standard and being rotatable with respect to the riser assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

Various embodiments of the invention provide various advantages, including the ability to quickly deploy foldable leg assemblies, easily level the bench, support the bench from a vehicle while the legs are deployed and adjusted for leveling the bench, among other advantages.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
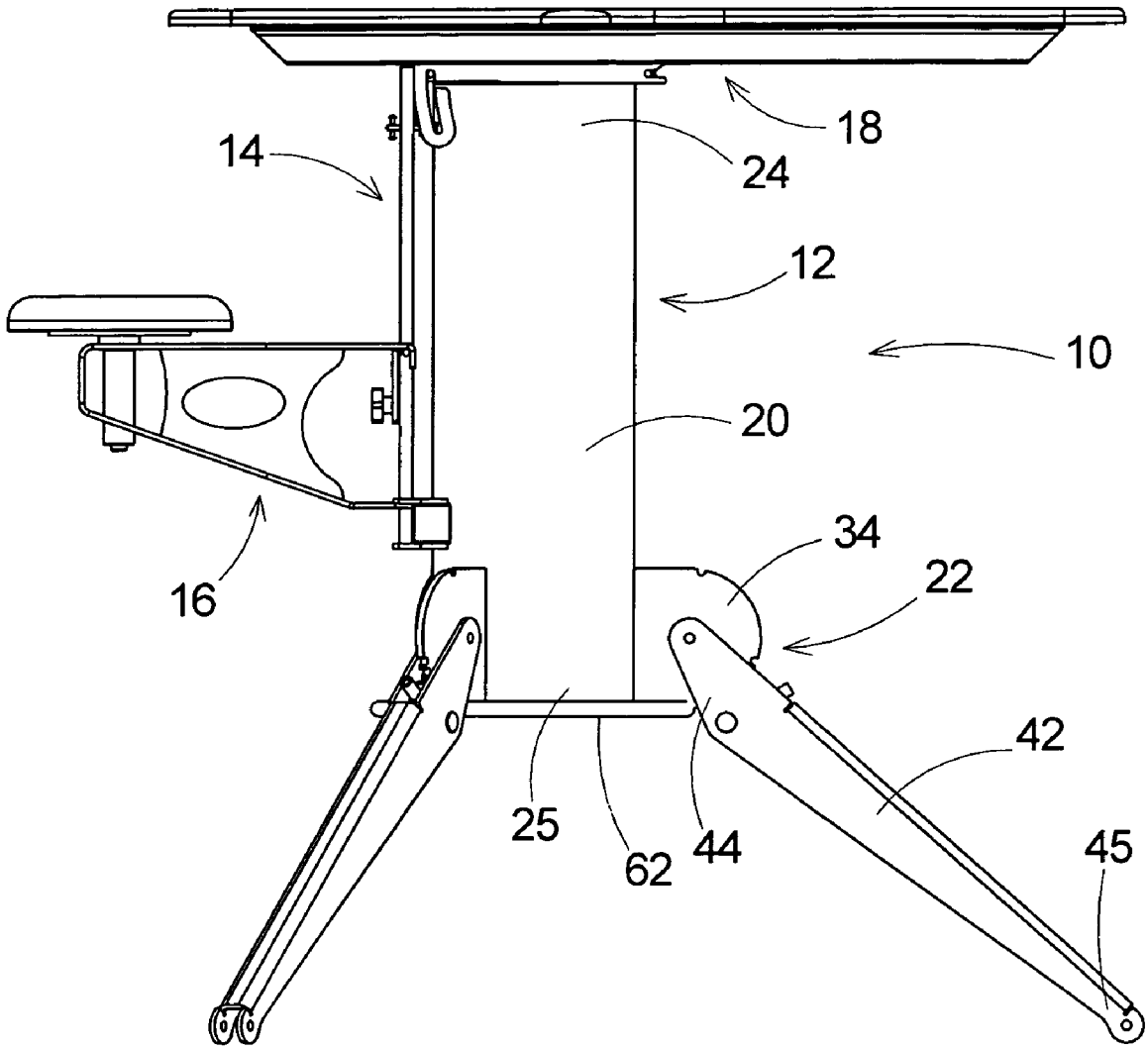
FIG. 1 is a schematic side view of a new shooting support bench according to the present invention.
Figure 2:
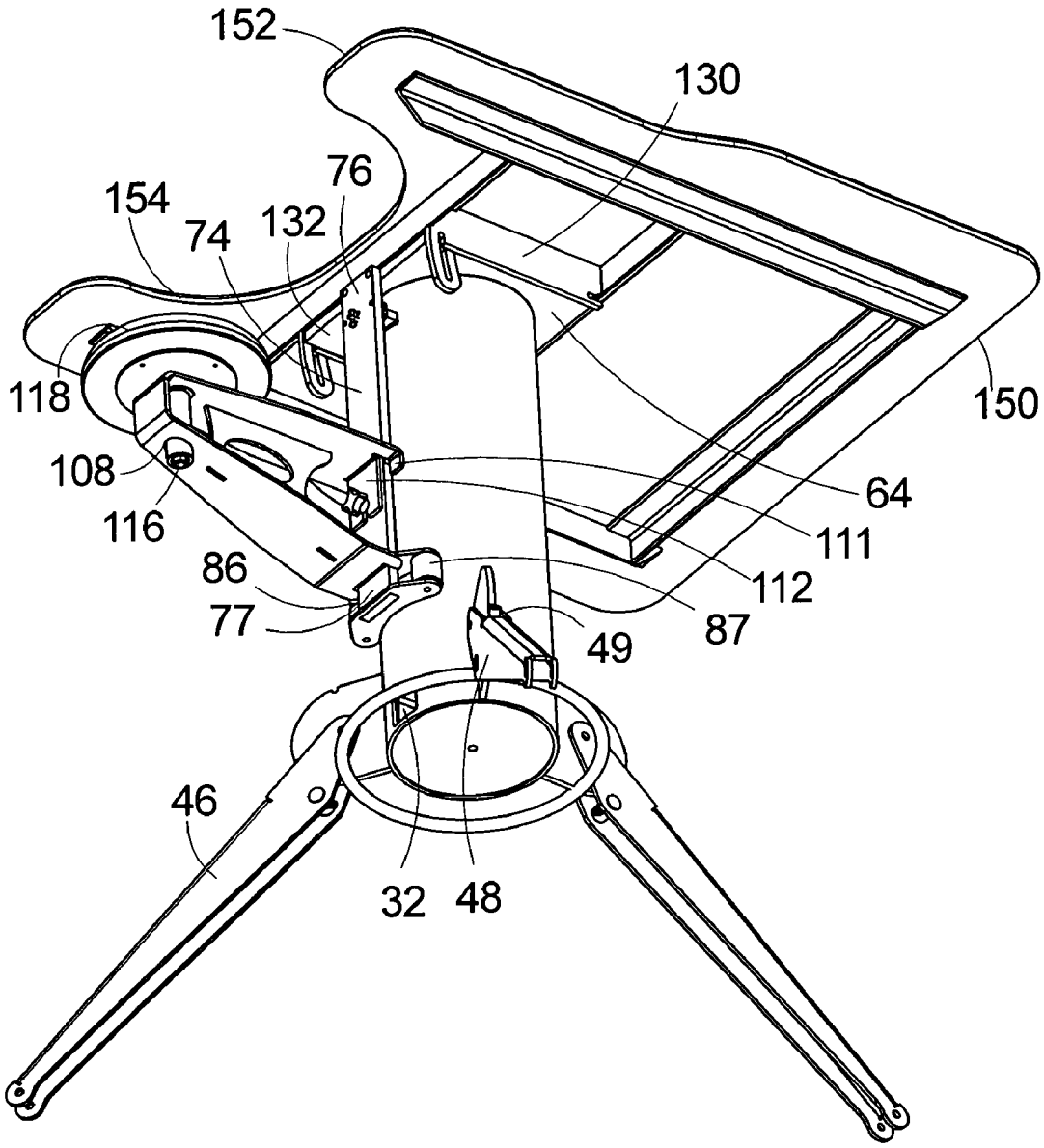
FIG. 2 is a schematic perspective view of the present invention.
Figure 3:
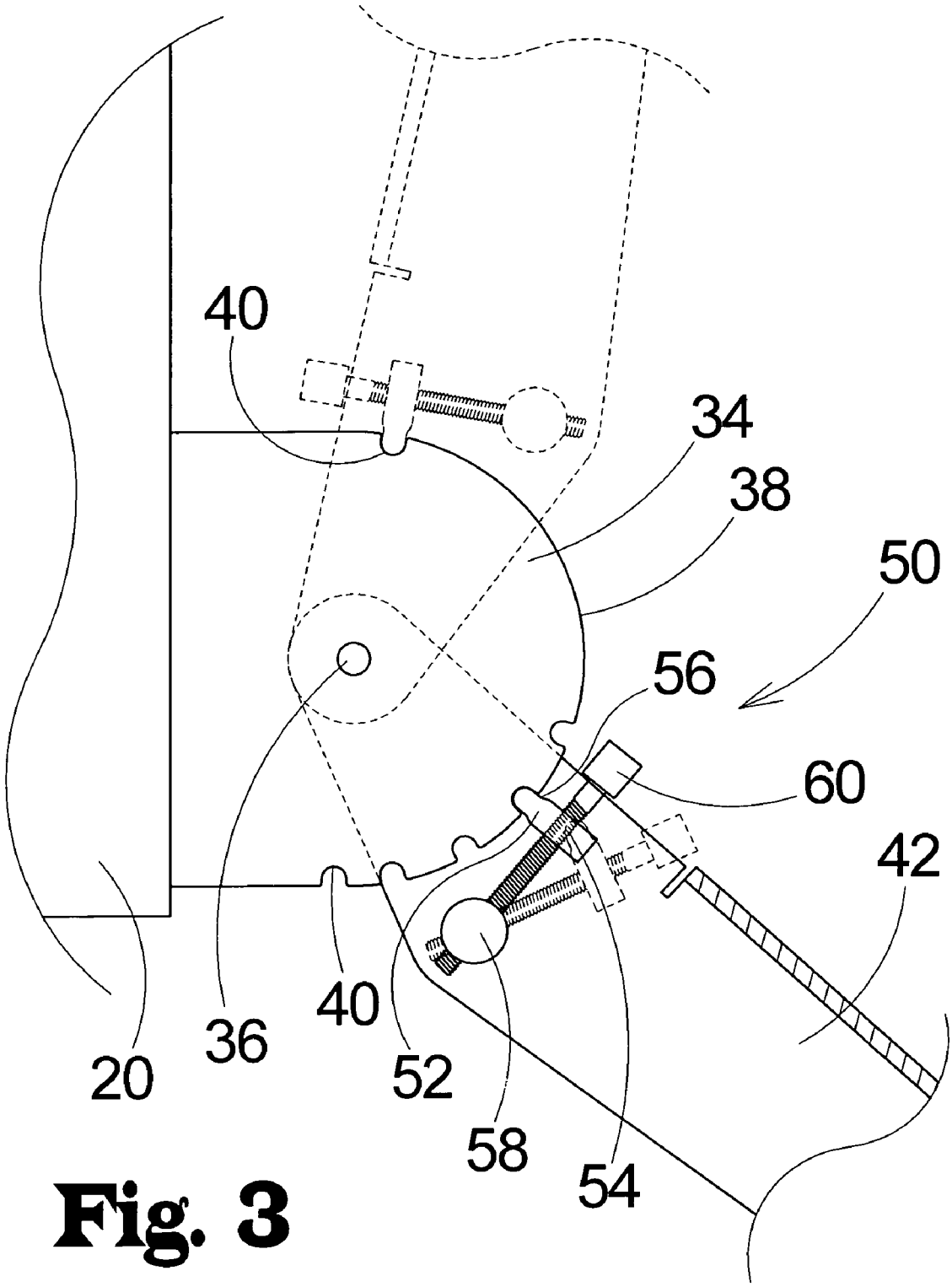
FIG. 3 is a schematic side sectional view of a portion of one of the leg assemblies of the present invention.
Figure 4:
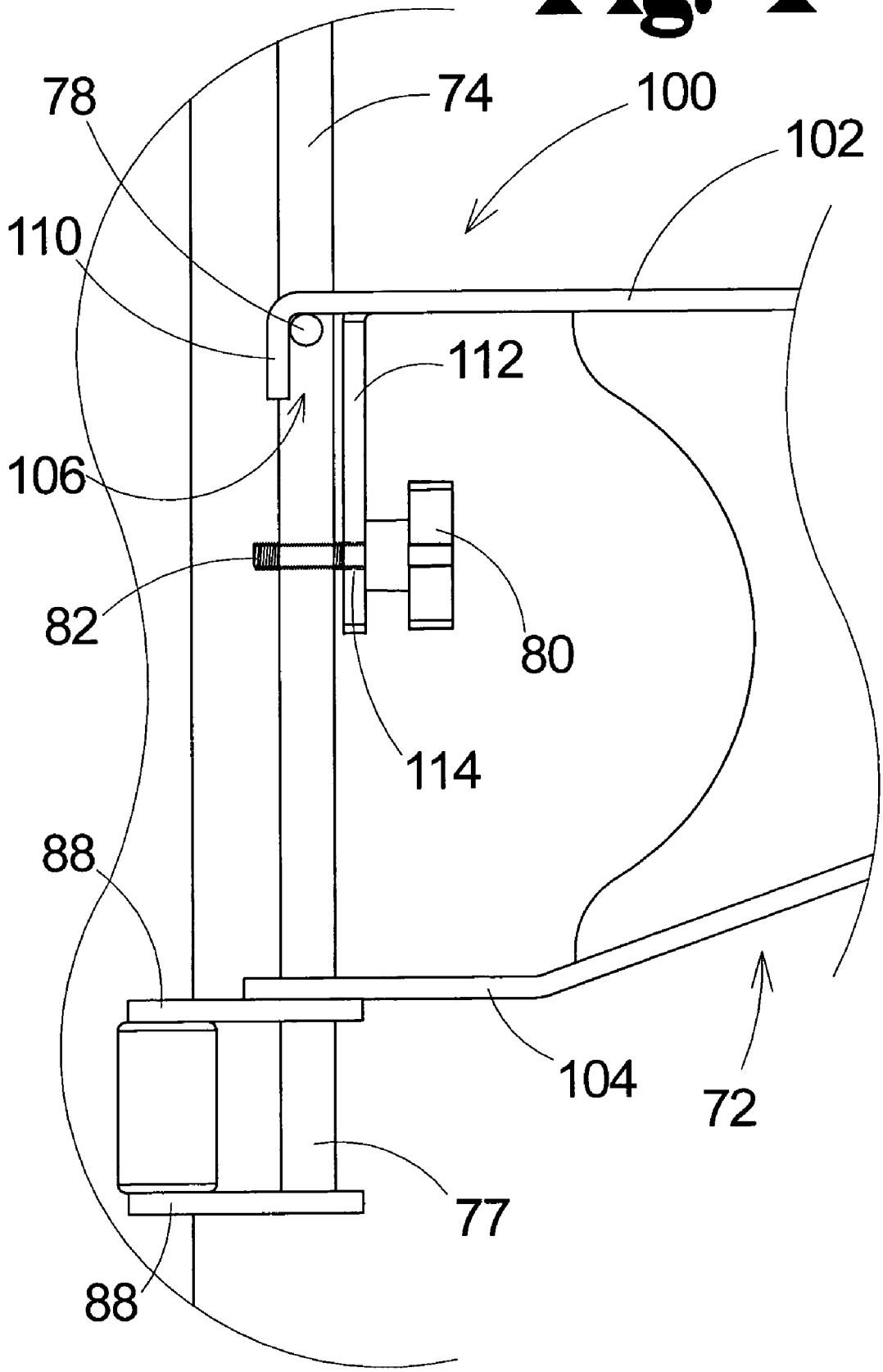
FIG. 4 is a schematic side view of a portion of the seat support assembly of the present invention.
Figure 5:
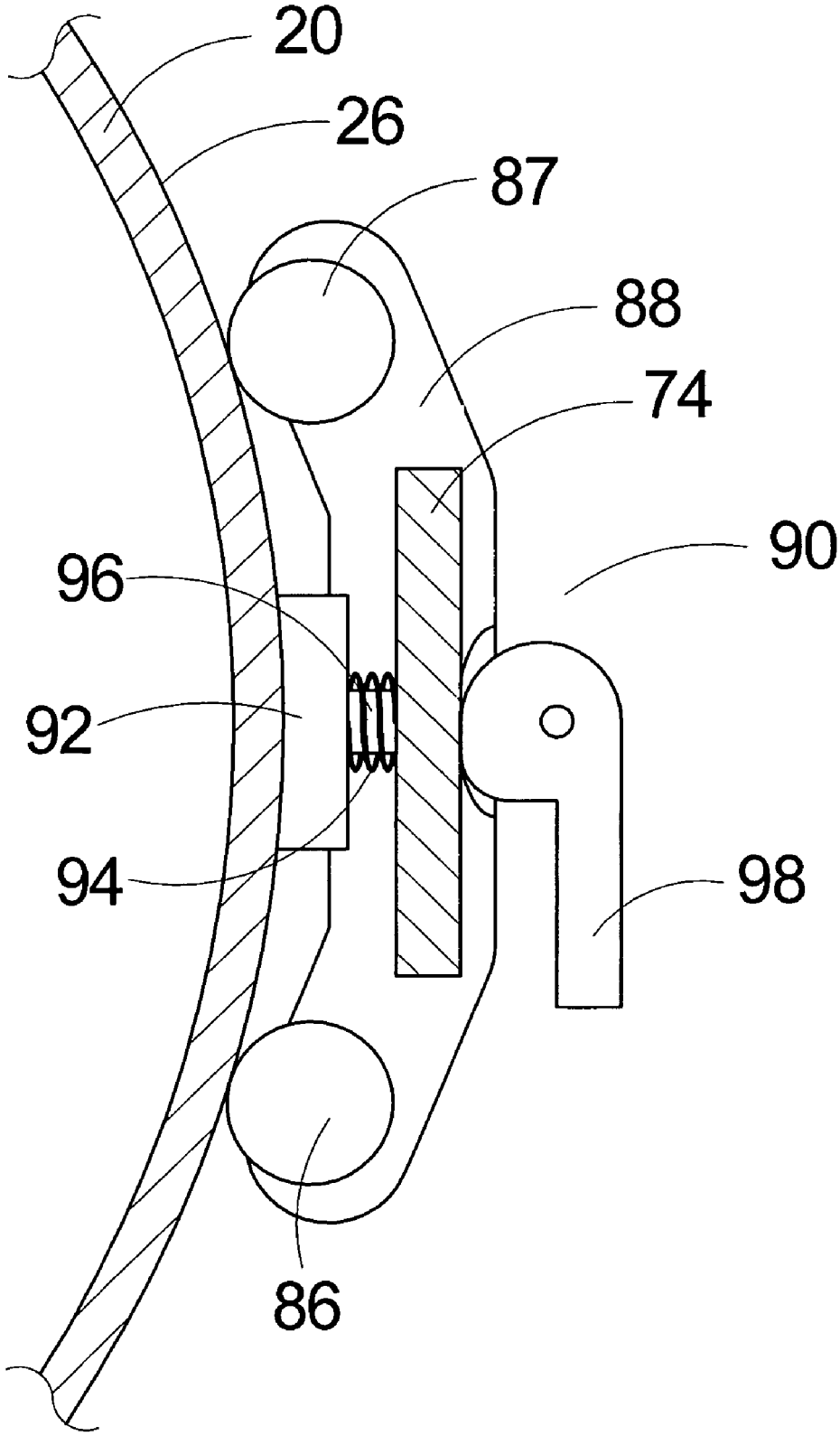
FIG. 5 is a schematic top view of a portion the seat support assembly of the present invention.
Figure 6:
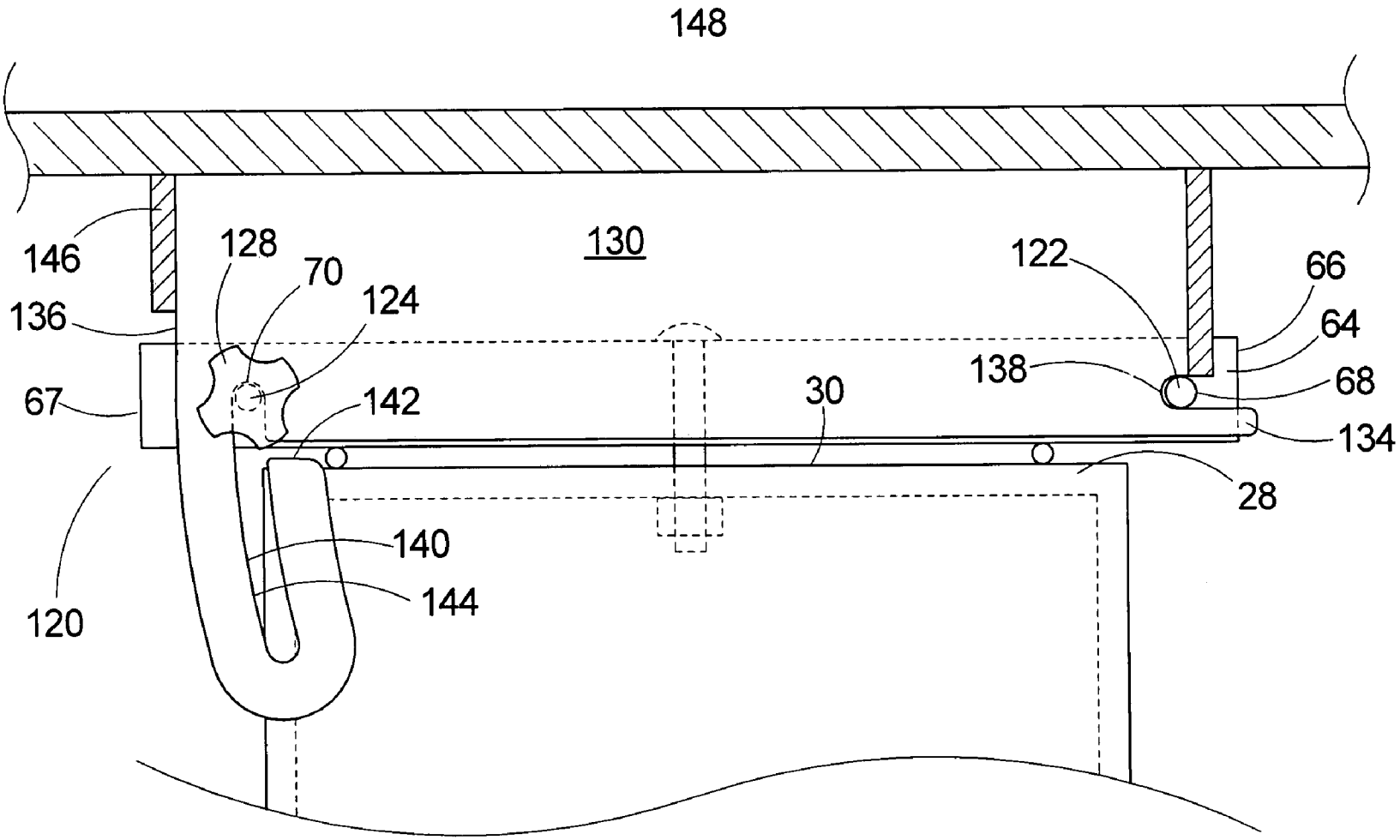
FIG. 6 is a schematic side sectional view of a portion of the mounting structure of the present invention.
Figure 7:
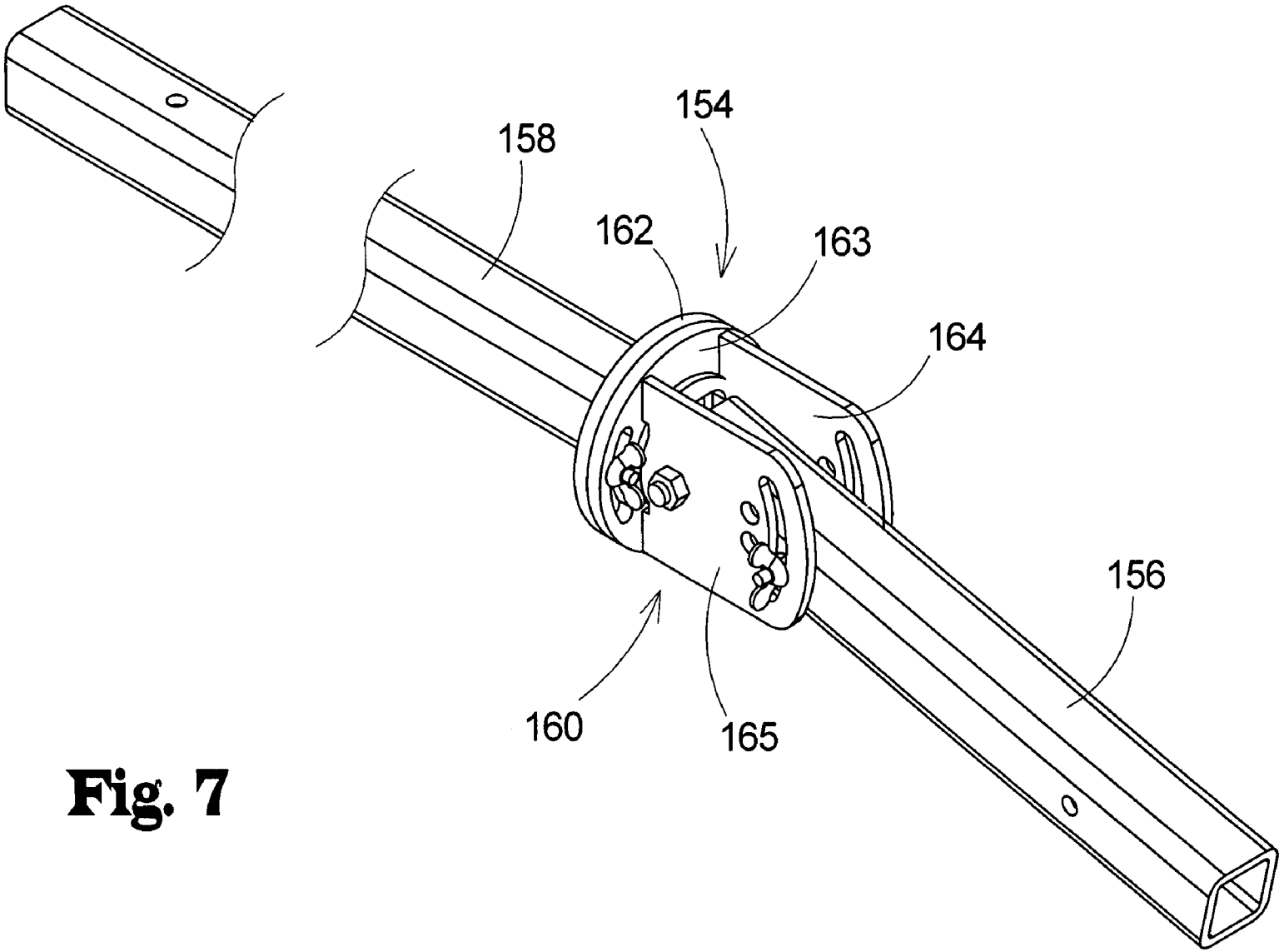
FIG. 7 is a schematic perspective view of a vehicle mounting assembly of the present invention.

With reference now to the drawings, and in particular to FIGS. 1 through 7 thereof, a new shooting support bench embodying the principles and concepts of the present invention and generally designated by the reference numeral 10 will be described.

As illustrated in FIGS. 1 through 7, the shooting support bench 10 of the invention is suitable for use when shooting a firearm, and is highly suitable for supporting a shooting rest such as that disclosed in my U.S. Pat. No. 6,877,266. Generally, the shooting support bench 10 includes a riser assembly 12, a support assembly 14 mounted on and rotatable with respect to the riser assembly, a seat assembly 16 mounted on the support assembly, and a platform assembly 18 mounted on the support assembly.

In greater detail, the riser assembly 12 generally comprises a standard 20 and a plurality of leg assemblies 22 that are mounted on the standard for selectively supporting the standard in an, elevated position. The standard 20 is substantially vertically oriented in use, and includes an upper end 24, a lower end 25, and an outer surface 26. The standard 20 may include an upper plate 28 that is mounted on the upper end 24 of the standard 20. The upper plate 28 may have an upper surface 30 that is oriented substantially perpendicular to a longitudinal axis of the standard 20. The standard 20 may also include a passage 32 that extends into the standard from the outer surface 26 of the standard inwardly. The passage 32 may be located toward the lower end 25 of the standard, and may have an axis that extends substantially perpendicular to a central longitudinal axis of the standard 20.

Each leg assembly 22 is mounted on the standard 20 and extends radially outwardly from the standard. The leg assemblies 22 may be substantially equally radially spaced from each other. In the illustrative embodiment, the plurality of leg assemblies 22 comprises three leg assemblies, and adjacent leg assemblies may have an angle of approximately 120 degrees therebetween.

Each of the leg assemblies 22 may include a pivot plate 34 that is mounted on the standard 20, and extends radially outwardly from the standard. The pivot plate 34 has a pivot hole 36 and an edge 38 with a plurality of locking notches 40 that extend into the edge 38. A leg 42 is pivotally mounted on the pivot plate 34, with an inner end 44 of the leg being pivotally mounted on the pivot plate and an outer end 45 for engaging and resting on a support surface when the bench 10 is in use. The leg 42 is thus pivotable with respect to the standard 20, with a stored position and at least one deployed position. The leg 42 preferably has at least two deployed positions each corresponding to one of the locking notches 40. The inner end 44 of the leg 42 defines a slot 46. A portion of the pivot plate 34 is positioned in the slot 46. The slot 46 is defined by a pair of arms 48, 49 that extend on each side of the pivot plate 34. The leg 42 may comprise a U-shaped channel.

Each of the leg assemblies 22 may further include an adjustable locking assembly 50 for releasably locking the leg 42 in a selected position. The locking assembly 50 may be pivotable with respect to the leg, with the locking assembly 50 being pivotable between an engaged position and a released position. The locking assembly 50 may comprise a cam member 52 for releasably engaging one of the notches 40 in the pivot plate 34. The cam member 52 may be movable into engagement with one of the notches 40 and may have an aperture 54 with a threaded interior. The cam member 52 has a cam surface 56 with a shape that is complementary to a shape of the notches 40 in the pivot plate.

The adjustable locking assembly 50 may further include a pivot pin 58 that is mounted on the leg 42. The pivot pin 58 may be pivotable with respect to the leg 42, and extends between sides of the U-shaped channel of the leg. The assembly 50 includes a cam support member 60 that is mounted on the pivot pin 58 so that the cam support member is pivotable with respect to the leg 42. The cam support member 60 has an exterior with a threaded portion, and the threaded portion extends through the aperture 54 in the cam member 52 such that rotation of the cam support member in a first direction moves the cam member 52 in a first direction along the cam support member and rotation in a second direction moves the cam member in a second, opposite direction along the cam support member.

In use, each of the legs 42 is pivoted from a stored or transport position (which may be a position in which the leg is oriented substantially parallel to the standard) toward a lowered, deployed position. When the leg 42 is in a position that will support the platform assembly at the desired height for use, the cam support member 60 may be pivot inwardly on the pivot pin 58 toward the plate 34 so that the cam member 52 engages one of the notches 40, to achieve a coarse height adjustment. This may be repeated for the other leg assemblies in turn. The cam support member 60 of each leg assembly may then be rotated either clockwise or counterclockwise to cause clockwise or counterclockwise pivot movement of the leg to achieve a position of the leg that results in the desired orientation of the platform assembly.

The riser assembly 12 may further include a footrest 62 that is mounted on the standard 20, and may be located adjacent to the lower end of the standard. The footrest 62 may be mounted on the plurality of leg assemblies 22. The footrest 62 may comprise a ring that may be positioned substantially concentric to a central longitudinal axis of the standard.

The support assembly 14 is rotatably mounted on the riser assembly 12 at the upper end of the standard 20. The support assembly 14 may comprise an interface plate 64 that is positioned above the standard 20, and is rotatable with respect to the standard. The interface plate 64 has opposite first 66 and second 67 ends. A first passage 68 is formed through the interface plate 64 at the first end 66 of the interface plate, and a second passage 70 is formed through the interface plate at the second end 67 of the interface plate.

The support assembly 14 may include a bearing assembly 72 that is positioned between the interface plate 64 and the upper plate 28 of the standard 20 to facilitate rotation of the interface plate with respect to the standard.

The support assembly 14 may include a seat support assembly 72 for supporting the seat assembly 16. The seat support assembly 72 may depend from the interface plate 64, and may further be positioned adjacent to the standard 20. The seat support assembly 72 is preferably substantially rigidly mounted to the interface plate 64 and abuts and contacts the standard 20.

The seat support assembly 72 may include an upright bar 74 that extends downwardly from the interface plate 64. The upright bar 74 has an upper end 76 that is mounted on the interface plate 64 and a lower end 77 positioned adjacent to the standard 20. A pair of securing tabs 78 may be mounted on the upright bar 74, and may extend outwardly from the upright bar. A securing knob 80 with a threaded shaft 82 may be mounted on the upright bar 74. The threaded shaft 82 is mounted in a threaded hole formed in the upright bar so that rotation of the securing knob in a first rotational direction tightens the mounting of the knob on the upright bar and rotation of the securing knob in a second rotational direction loosens the mounting of the knob on the upright bar.

The seat support assembly 72 may comprise a standard engaging structure 84 for engaging the standard. The standard engaging structure 84 is mounted on the upright bar 74 toward the lower end 77 thereof. The standard engaging structure 74 may comprise at least one roller 86 abutting the exterior of the standard such that the roller is rollable on the outer surface 26 of the standard. In the preferred embodiment, the standard engaging structure 84 includes a pair of rollers 86, 87 that abut the outer surface of the standard. The rollers 86, 87 may be laterally spaced with respect to the upright bar 74. A pair of support plates 88 may be mounted on the upright bar 74, and the pair of rollers may be mounted on the support plates 88. By this structure and its equivalents, the weight of the user on the seat is transferred to the surface of the standard 20, and is not solely supported in a cantilevered manner by the interface plate 64 and the bearing assembly 72 acting on the upper end of the standard.

The seat support assembly 72 may further include a position locking structure 90 for releasably securing a rotational position of the upright bar 74 with respect to the riser assembly 12. In the most preferred embodiments, the position locking structure 90 is preferably mounted on the upright bar 74. The position locking structure 90 may comprise an abutment pad 92 for selectively abutting the outer surface 26 of the standard. The abutment pad 92 may have an arcuate abutment surface for selectively contacting the outer surface 26 of the standard. The locking structure 90 may also include a post 94 that extends through the upright bar 74, and the abutment pad 92 is mounted on the post. The post 94 is movable with respect to and through the upright bar 74 to bring the abutment pad into and out of contact with the standard. The position locking structure may further include a spring 96 for biasing the abutment pad 92 against the outer surface 26 of the standard. The spring 96 is preferably mounted on the post 94. The position locking structure 90 may also include a locking lever 98 that is pivotally mounted on the post 94 and is movable between a released position and an engaged position. The locking lever 98 has a camming surface for abutting the upright bar 74 such that movement of the locking lever from the released position to the engaged position moves the post 94 and the abutment pad 92 toward the standard and into contact with the outer surface 26, and movement of the locking lever from the engaged position to the released position moves the post and the abutment pad away from the standard and out of contact with the outer surface. In use, the user rotates the support assembly 14 with respect to the riser assembly 12 to achieve the desired position of the seat assembly 16, and then moves the locking lever 98 so that it presses the abutment pad 92 against the standard 20. Moving the locking lever 98 to the position releasing the abutment pad from abutting the standard permits the support assembly to be rotated and repositioned.

The seat assembly 16 may be removably mounted on the seat support assembly 14 for rotation with the support assembly and relative to the riser assembly 12. The seat assembly 16 may comprise an arm 100 that is removably mounted on the seat support assembly 14. The arm 100 may include an upper extent 102 and a lower extent 104, and each of the upper 102 and lower 104 extents may define a channel 106 for receiving a portion of the upright bar 74. The upper 102 and lower 104 extents may form a substantially U-shaped structure for the arm 100. A seat aperture 108 may be formed in each of the upper and lower extents of the arm. The seat apertures 108 may be substantially axially aligned with each other along a substantially vertical axis. The upper extent 102 may have an ear 110, 111 located on each side of the channel 106 defined by the arm. Each of the ears 110, 111 may form a hook for removably hooking onto one of the securing tabs 78 on the upright bar 74. The upper extent 102 of the arm may also include an abutment plate 112 for abutting against the upright bar 74 when the upright bar is positioned in the channels 106 of the upper 102 and lower 104 extents. The abutment plate 112 may further define a slot 114 for receiving the threaded shaft 82, so that the securing knob 80 may be selectively tightened against abutment plate to hold the abutment plate, and the remainder of the seat assembly, in position against the upright bar. Loosening of the knob thus permits the seat assembly to be removed from the support assembly for transport and storage. The seat assembly may also include a seat post 116 that is removably insertable into the seat apertures 108 of the arm 100. A seat 118 is mounted on the seat post 116 for supporting a user.

The platform assembly 18 may be mounted on the support assembly 14 and the riser assembly 12, and preferably the platform assembly is rotatable with respect to the riser assembly 12. In some embodiments, the platform assembly 18 is tiltable with respect to the riser assembly 12. The platform assembly 18 may comprise a mounting structure 120, which may include a first mounting rod 122 mounted on the interface plate 64. The first mounting rod 122 may extend through the first passage 68 of the interface plate 64 and may extend outwardly in substantially opposite directions from the plate 64. The platform assembly 18 may further include a second mounting rod 124 mounted on the interface plate 64 and may extend through the second passage 70 of the interface plate 64. The ends of the second mounting rod 124 may extend in substantially opposite directions from the plate 64. A first end of the second mounting rod 124 has a head located thereon and a second end of the second mounting rod is threaded and has a knob 128 threaded mounted on the second end.

The mounting structure 120 may further include a pair of side plates 130, 132. Each of the side plates 130, 132 has opposite first 134 and second 136 end edges. Each of the side plates 130, 132 includes a first mounting slot 138 for removably receiving the first mounting rod 122. The first mounting slot 138 extends into the first end edge 134 toward the second end edge 136. Each of the side plates 130, 132 includes a second mounting slot 140 for removably receiving the second mounting rod 124. The second mounting slot 140 extends into the edge of the side plate. The second mounting slot 140 has a first portion 142 that extends substantially parallel to the first mounting slot 138 to permit the first mounting rod 122 and the second mounting rod 124 to simultaneously move into the first 138 and second 140 mounting slots. A second portion 144 of the second mounting slot 140 extends in a substantially perpendicular direction to the first mounting slot 138 to permit pivoting of the side plate 130, 132 about the first mounting rod 122 when the first mounting rod is positioned in the first mounting slot. By this structure, and its equivalents, the first and second mounting rods may be substantially simultaneously moved into the first mounting slot and the first portion of the second mounting slot by movement of the side plates that is substantially perpendicular to the axis of the standard, until the first mounting rod is substantially fully seated in the first mounting slot, and then the side plates may be pivoted on the first mounting rod to move the second mounting rod along the second portion of the second mounting slot, which permits the platform assembly to be tilted with respect to the riser assembly, and is not limited to a level or horizontal orientation. The knob 128 may then be tightened on its threads to hold the side plates in the desired position with respect to the second mounting rod and the interface plate.

The platform assembly 18 may also include a frame 146 that is mounted on the mounting structure 120. The frame 146 is mounted on the side plates 130, 132 of the mounting structure 120.

The platform assembly 18 may also include a table top 148 that is mounted on the frame 146. The table top 148 has a forward edge 150 and a rearward edge 152. The rearward edge 152 may have an arcuate cutout 154 extends into the table top toward the forward edge 150 for accommodating a portion of the torso of the user. The upper surface of the table top may be adjusted in orientation in the manner described above for adjusting the orientation of the platform assembly.

As an optional feature, the invention may include a vehicle mounting assembly 154 for temporarily mounting the riser assembly on the vehicle prior to, for example, deployment of the legs assemblies from the stored position to one of the deployed positions. The vehicle mounting assembly 154 may include a vehicle mounting member 156 that is at least partially insertable, for example, into the hitch receiver tube of a vehicle. The vehicle mounting assembly 154 may further include a riser mounting member 158 that is insertable, for example, into the passage 32 that extends into the standard 20 of the riser assembly. When each of the members 156, 158 are mounted in the manner thus described, the support bench 10 may be supported on the vehicle prior to deployment of the leg assemblies of the bench 10. In some embodiments of the vehicle mounting assembly, the vehicle mounting member 156 and the riser mounting member 158 are connected together in a manner that permits pivoting of the vehicle mounting member with respect to the riser mounting member 158 about one axis, and preferably two perpendicular axes, to permit the riser mounting member to be oriented freely with respect to the vehicle mounting member when the vehicle mounting member is mounted on a vehicle. With this capability, the riser mounting member 158, and the riser assembly 12 into which the member 158 is inserted, may be brought into a level condition without requiring the vehicle to be oriented in a level condition. Once the table top of the platform assembly has been leveled in this manner, the leg assemblies 22 may be brought into contact with the ground surface and the legs 42 locked into position using the adjustable locking assembly 50 of each leg assembly.

In the illustrated vehicle mounting assembly 154, the members 156, 158 are connected together by a biaxial adjustment assembly 160 that is connected to ends of the members. The biaxial adjustment assembly 160 may include a pair of abutment plates 162, 163 that are rotatable about a common central axis with respect to each other. A first abutment plate 162 is mounted on the riser mounting member 158, and an abutment second plate 163 is rotatable with respect to the first plate about the common central axis which is substantially parallel to the longitudinal axis of the member 158. A pair of ear plates 164, 165 are mounted on the second plate 163, and extend in a direction away from the first abutment plate 162. The ear plates 164, 165 may be oriented substantially parallel to each other. An end portion of the vehicle mounting member 158 is positioned between the ear plates 164, 165, and is pivotable between the plates 164, 165. Various means may be provided for releasably securing the abutment plates 162, 163 against rotation with respect to each other, and for releasably securing the vehicle mounting member 158 against pivot movement with respect to the ear plates 164, 165. By this structure, and its equivalents, the user may orient the riser assembly and the platform assembly before deploying the leg assemblies by inserting the vehicle mounting member into the hitch receiver of a vehicle, inserting the riser mounting member into the passage of the standard, and adjusting the biaxial adjustment assembly to achieve the desired orientation of the platform assembly. Once this is accomplished, the user may then deploy the leg assemblies by bringing the ends of the legs into contact with the ground surface using the aforedescribed leg adjustment procedure. Optionally, the bench may be transported for short distances using the vehicle mounting assembly after the leg assemblies have been moved to a transport position.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly; all suitable modifications and equivalents may be resorted to, falling within the scope of the invention.

I claim:

1. A shooting support bench for supporting a firearm, comprising:

a riser assembly for positioning on a support surface, the riser assembly comprising a standard having an upper end and a lower end; and a plurality of leg assemblies pivotally mounted on the standard toward the lower end of the standard;

a support assembly rotatably mounted on the upper end of the standard, the support assembly including a seat support assembly rotatable about the standard of the riser assembly;

a seat assembly removably mounted on the seat support assembly such that the seat assembly and the seat support assembly rotate with respect to the riser assembly, the seat assembly rotating about the standard; and a platform assembly mounted on the support assembly at a location relatively higher than the seat assembly, the platform assembly being positioned above the upper end of the standard and being rotatable with respect to the riser assembly;

wherein the platform assembly is tiltable with respect to the riser assembly about a substantially horizontal axis to raise a rearward edge of the platform located relatively closer to the seat assembly with respect to a forward edge of the platform located relatively farther away from the seat assembly than the rearward edge.

2. The bench of claim 1 wherein each of the leg assemblies comprises:

a pivot plate mounted on the standard, the pivot plate having a plurality of notches along an edge of the plate;

a leg pivotally mounted on the pivot plate; and an adjustable locking assembly for releasably locking the leg in a selected position.

3. The bench of claim 2 wherein the locking assembly comprises:

a cam member for releasably engaging one of the notches in the pivot plate;

a pivot pin mounted on the leg;

a cam support member mounted on the pivot pin so that the cam support member is pivotable with respect to the leg, the cam support member having an exterior with a threaded portion, the threaded portion of the cam support member extending through a threaded aperture in the cam member such that rotation of the cam support member in a first direction moves the cam member in a first direction along the cam support member and rotation in a second direction moves the cam member in a second, opposite direction along the cam support member.

4. The bench of claim 1 wherein the support assembly comprises:

an interface plate positioned above and rotatable with respect to the standard, the interface plate being positioned at a location lower than the platform; and wherein the seat support assembly is mounted on and depends from the interface plate, the seat support assembly abutting against the standard.

5. The bench of claim 4 wherein the seat support assembly comprises:

a upright bar extending downwardly from the interface plate; and a standard engaging structure mounted on the upright bar for engaging the standard, the standard engaging assembly rolling against an outer surface of the standard.

6. The bench of claim 1 wherein the support assembly comprises a seat support assembly supporting the seat assembly; and wherein the seat support assembly additionally comprises a position locking structure for releasably securing a rotational position of the seat support assembly with respect to the riser assembly.

7. The bench of claim 6 wherein the position locking structure includes an abutment pad for selectively abutting the exterior surface of the riser assembly, and a locking lever configured for moving the abutment pad between a released position characterized by the abutment pad being out of contact with the exterior surface of the riser assembly, and an engaged position characterized by the abutment pad abutting the exterior surface of the riser assembly.

8. The bench of claim 1 wherein the support assembly includes an interface plate mounted on the riser assembly; and the platform assembly comprising a mounting structure including:

a first mounting rod mounted on the interface plate;

a second mounting rod mounted on the interface plate; and a pair of side plates positioned on opposite sides of the interface plate, each of the side plates removably receiving an end of each of the first and second mounting rods.

9. The bench of claim 8 wherein each of the side plates has opposite first and second end edges, each of the side plates including:

a first mounting slot for removably receiving the first mounting rod, the first mounting slot extending into the first end edge toward the second end edge;

a second mounting slot for removably receiving the second mounting rod, the second mounting slot being located rearwardly of the first mounting slot on the side plate, the second mounting slot extending into the side plate in a configuration such that the first mounting rod is capable of being moved into the first mounting slot simultaneously with the second mounting rod being moved into the second mounting slot.

10. The bench of claim 9 wherein the second mounting slot has a first portion extending substantially parallel to the first mounting slot to permit the first mounting rod and the second mounting rod to simultaneously move into the first and second mounting slots, a second portion of the second mounting slot extending in a substantially perpendicular direction to the first mounting slot to permit pivoting of the side plate about the first mounting rod when the first mounting rod is positioned in the first mounting slot.

11. The bench of claim 1 wherein each of the leg assemblies comprises a locking assembly for adjustably locking the leg assembly against movement with respect to the riser assembly, each of the locking assemblies comprising a pivotable cam member configured to releasably engage one of a plurality of notches on a pivot plate mounted on the standard of the riser assembly to provide a coarse adjustment of a locked position of a leg of the leg assembly, the cam member being threadedly mounted on a cam support member on the leg such that rotation of the cam support member moves the leg with respect to the cam member to provide a fine adjustment of the locked position of the leg.

12. The bench of claim 1 additionally comprising a vehicle mounting assembly for temporarily mounting the riser assembly on a vehicle, the vehicle mounting assembly comprising:

a vehicle mounting member for mounting on a hitch receiver tube of the vehicle;

a passage extending into the standard of the riser assembly;

a riser mounting member removably insertable into the passage of the riser assembly; and a biaxial adjustment assembly connecting the vehicle mounting member and the riser mounting member in a manner permitting adjustment of an orientation of the riser mounting member about at least two axes with respect to the vehicle mounting member, the axes being oriented substantially perpendicular to each other.

13. The bench of claim 1 wherein the seat assembly is removable from the support assembly without removal of the platform assembly from the standard of the riser assembly and without removal of the plurality of leg assemblies from the standard of the riser assembly.

14. The bench of claim 1 wherein the standard has an exterior surface, and wherein at least a portion of the support assembly and the seat assembly rotates about the exterior surface of the standard.

15. The bench of claim 14 wherein the support assembly abuts against the exterior surface of the standard to provide support to the support assembly and the seat assembly.

16. The bench of claim 15 additionally comprising a position locking structure mounted on the support assembly to selectively lock the support assembly and platform assembly against rotation with respect to the standard, the position locking structure locking the support assembly in a selected rotational position by increasing an abutment force exerted by the support assembly on the exterior surface of the standard.

17. The bench of claim 1 wherein the standard of the riser assembly remains stationary as the seat assembly rotates about the standard.

18. The bench of claim 1 wherein the platform assembly, the support assembly and the seat assembly are rotatable with respect to the riser assembly as a single unit about a substantially vertical axis, positions of the platform assembly, the support assembly and the seat assembly with respect to each other about the substantially vertical axis being fixed.

19. A shooting support bench for supporting a firearm, comprising:

a riser assembly for positioning on a support surface, the riser assembly comprising a standard having an upper end and a lower end, a plurality of leg assemblies pivotally mounted on the standard toward the lower end of the standard;

a support assembly rotatably mounted on the upper end of the standard;

a seat assembly removably mounted on the support assembly for rotation with the support assembly with respect to the riser assembly; and a platform assembly mounted on the support assembly at a location relatively higher than the seat assembly, the platform assembly being positioned above the upper end of the standard and being rotatable with respect to the riser assembly;

wherein the support assembly comprises:

an interface plate positioned above and rotatable with respect to the standard, the interface plate being positioned at a location lower than the platform; and a seat support assembly for supporting the seat assembly, the seat support assembly being mounted on and depending from the interface plate, the seat support assembly abutting against the standard.

20. A shooting support bench for supporting a firearm, comprising:

a riser assembly for positioning on a support surface, the riser assembly comprising a standard having an upper end and a lower end; and a plurality of leg assemblies pivotally mounted on the standard toward the lower end of the standard;

a support assembly rotatably mounted on the upper end of the standard, the support assembly including a seat support assembly rotatable about the standard of the riser assembly;

a seat assembly removably mounted on the seat support assembly such that the seat assembly and the seat support assembly rotate with respect to the riser assembly, the seat assembly rotating about the standard; and a platform assembly mounted on the support assembly at a location relatively higher than the seat assembly, the platform assembly being positioned above the upper end of the standard and being rotatable with respect to the riser assembly;

wherein the seat assembly is removable from the support assembly without removal of the platform assembly from the standard of the riser assembly and without removal of the plurality of leg assemblies from the standard of the riser assembly.

* * * * *